US008181501B2

(12) United States Patent
Mariani et al.

(10) Patent No.: US 8,181,501 B2
(45) Date of Patent: May 22, 2012

(54) TOOL FOR RAMMER DIE-CUTTING

(75) Inventors: Georgio Mariani, Franconville (FR); Christophe Perret, La Garenne Colombes (FR)

(73) Assignee: SNECMA, Paris (FR)

( * ) Notice: Subject to any disclaimer, the term of this patent is extended or adjusted under 35 U.S.C. 154(b) by 976 days.

(21) Appl. No.: 12/145,911

(22) Filed: Jun. 25, 2008

(65) Prior Publication Data

US 2009/0000452 A1 Jan. 1, 2009

(30) Foreign Application Priority Data

Jun. 25, 2007 (FR) ..... 07 04546

(51) Int. Cl.
*B21D 22/00* (2006.01)
*B21D 37/10* (2006.01)

(52) U.S. Cl. ..... 72/360; 72/456; 72/352; 72/361; 72/475

(58) Field of Classification Search ..... 72/455, 72/456, 360, 352, 361, 328, 329, 336, 344, 72/427, 470, 471, 475
See application file for complete search history.

(56) References Cited

U.S. PATENT DOCUMENTS

| | | | | |
|---|---|---|---|---|
| 2,342,021 | A * | 2/1944 | Swanson | 72/358 |
| 3,388,583 | A * | 6/1968 | Nye | 72/456 |
| 4,860,567 | A | 8/1989 | Askey et al. | |
| 4,918,956 | A * | 4/1990 | Schoch | 72/21.1 |
| 5,249,451 | A * | 10/1993 | Aranovsky et al. | 72/361 |
| 2006/0266093 | A1 * | 11/2006 | Lorbach | 72/361 |

FOREIGN PATENT DOCUMENTS

| | | |
|---|---|---|
| DE | 103 56 269 B3 | 4/2005 |
| EP | 0 163 769 A2 | 12/1985 |
| FR | 2 277 636 | 2/1976 |

* cited by examiner

*Primary Examiner* — Edward Tolan
*Assistant Examiner* — Pradeep C Battula
(74) *Attorney, Agent, or Firm* — Oblon, Spivak, McClelland, Maier & Neustadt, L.L.P.

(57) ABSTRACT

A tool for rammer die-cutting an annular part is disclosed. The tool includes a lower insert holder with a lower die cooperating with an upper insert holder and an upper die. Both dies include a die-cutting annular recess. The tool further includes a guiding device for guiding the part, restricting side shifts of the part while the part is lifted from the lower die. More particularly, the guiding device includes a column projecting from the lower die. The tool enables one to control the rebounding of a part and prevents it from turning upside down.

7 Claims, 1 Drawing Sheet

TOOL FOR RAMMER DIE-CUTTING

Figure 1:
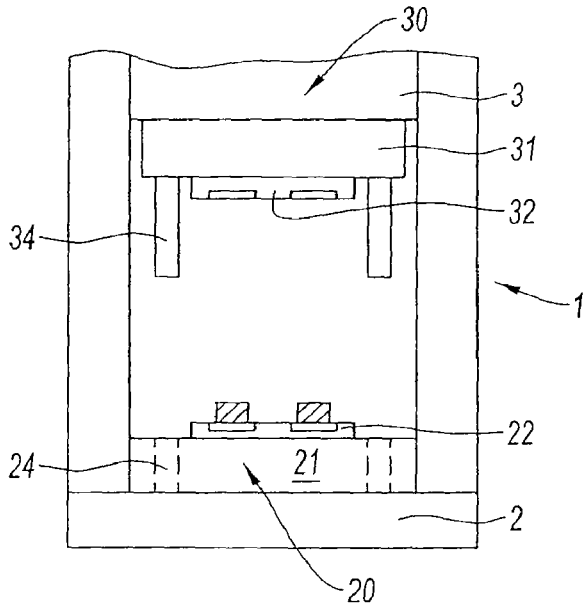
Fig. 1 PRIOR ART

The present invention relates die-cutting metallic parts using a rammer, more particularly die-cutting annular parts and provides a securing means during the die-cutting operation.

Die-cutting forging comprises forming through plastic deformation blank parts initially brought at an appropriate temperature. Such parts are made in non ferrous alloys, such as aluminum, copper, titanium, nickel, etc.

Die-cutting is thus a forging operation performed using a tool comprising dies: an upper half die and a lower half die being brought closer to each other. Dies are engraved according to the part shape.

In the field of aeronautical turbomachines, such a die-cutting technique makes it possible to manufacture, for instance, turbine discs. Such parts have an annular shape and are referred to as unblocked, that is with a central aperture. These are additionally relatively light, in the order of 100 kg for one turbine disc.

More accurately, a rammer comprises two fixed frame members each supporting an insert holder and an insert or die. The upper insert holder guided by vertical columns is driven at a velocity ranging from 1 to 2 m/s against the lower insert on the die from which is positioned the blank to be hit. Both dies are appropriately engraved so as to yield the desired shape. When both half dies come into contact by means of the part, all the energy is transferred to the material thereof. Part is absorbed by the plastic deformation of the metal, part is transformed into heat and another part is transformed into mechanical energy. The latter is obtained through contact between both inserts occurring after some strokes after the part has become partially out of shape. Because of the elasticity of the metal constituting the inserts, said mechanical energy is transferred from the inserts to the part. When the insert holder resumes its stroke upwards, the part is released and thereby tends to jump and to rebound. On known dies, while rebounding, the part is likely to get out the engraving, slide on the insert, or even fall out of the die. The part could also turn upside down while rebounding.

In both those cases, the presence of a forging workman in the vicinity of the machine is required for repositioning the part.

A solution would be to implement a die with a bowl. Such a solution is advantageous as it is applicable as well to non annular parts, but the tool is expensive primarily because of the material additional cost; moreover, the access to the part is harder as it is located at the bottom of the bowl. Thus, despite its benefits, such a solution is not overall satisfactory.

A first objective of this invention aims at finding a means relating to die-cutting an annular part which, while the part is rebounding, makes it possible for the latter to be held on the tool.

Another objective of this invention is to find a means being also able to hold the part at the centre of the tool after rebounding.

Still another objective of this invention is to prevent the part from turning upside down.

The above mentioned objectives are achieved using a tool for rammer die-cutting of an annular part comprising a lower insert holder, with a lower die, cooperating with an upper insert holder and an upper die, both dies comprising a die-cutting annular recess. The tool is characterized in that it comprises a means for guiding the part, restricting its side shifts while being lift from the lower die.

Using such a guiding means on the tool, the part is securely held on the latter when it becomes ejected in the air. As a result, the personal being in the vicinity of the rammer is thereby protected. Risks of damaging parts through uncontrolled amplitude rebounds are also substantially reduced. The solution of this invention makes it possible to indirectly apply a higher power to the rammer than in the prior art, when this is required for some parts. With prior art rammers, indeed, while trying to prevent rebounds, the level of applied power is on the contrary limited. Such an increase of power level has an effect on the part quality.

Advantageously, the guiding means comprises a column arranged between both dies located inside the crown formed by the annular recess. A central column is advantageous in that it brings the part back in the die-cutting recess while rebounding drives the latter against the column, and prevents or restricts the forging workman's intervention. This even reduces the hazards related to handling heavy parts and at a high temperature. More particularly, the height of the column is at least equal to the rebounding height of the part. The central location, while restricting the part shift, also prevents it from being turned upside down through rebounding.

Preferably, the column is interdependent with the lower die. More specifically, the lower die comprises a bore, arranged in the axis of the crown formed by the die-cutting recess, wherein the column is housed. One wedging means is for example made of an axial wedging collar, provided on the column cooperating with a housing arranged in the lower die.

For ensuring an optimum operation, the column is fixed and the upper die comprises a bore for receiving the upper part of the column. More particularly, the hole arranged in the upper die comprises a centering cone.

This invention also relates to a method for rammer die-cutting an annular part comprising positioning a tool according to this invention in the rammer, followed by hitting the part using such a tool.

The Applicant also knows the document DE 10356269 relative to a press for thixoforming a metal in a fluid or paste condition. In an embodiment, a column, positioned in the centre of the annular part to be formed, cooperates with tightness members for containing the metal during deformation. The column in such a press type does not fulfil any guiding nor retaining function of the part as there does not occur any rebound, the shifting velocities being very low, lower than 0.1 m/s.

Figure 2:
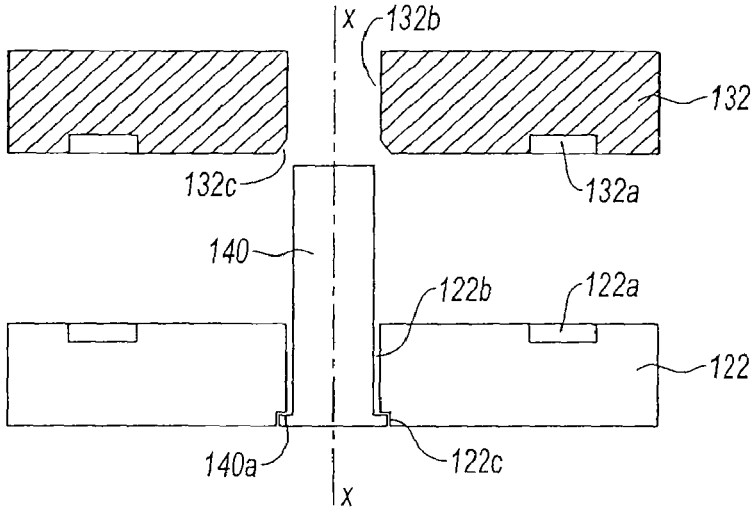
Figure 3:
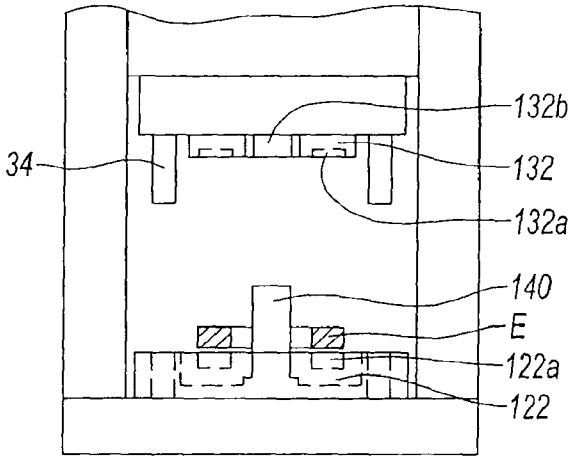

Other features and benefits will become more apparent from the specification according to an embodiment of this invention in reference to the drawings on which:

FIG. 1 schematically illustrates a rammer;

FIG. 2 shows a sectional view of a tool of this invention with a lower die and an upper die perforated with a central hole for respectively housing and guiding a centering column; and FIG. 3 shows the tool of this invention mounted on a rammer.

As can be seen on FIG. 1, a rammer 1 comprises a lower fixed frame 2 and an upper fixed frame 3 on top of the latter. Both frames each hold a tool. The lower tool 20 comprises an insert holder 21 and an insert or a die 22. The upper tool 30 comprises an insert holder 31 and an insert or a die 32. The dies are fixed in the respective insert holder removably, either through hooping or by means of keys. Both dies 22 and 32 each comprise a die-cutting recess and provided therebetween, when being positioned one on the other, the volume of the part to be achieved. One appropriate mechanism provides for the shift of both insert holders, one towards the other. The part P is hit and shaped in the die-cutting recess. Columns 34 provided on the upper insert holder cooperate with bores 24 arranged in the lower insert holder such that both dies are centred one relative to the other.

The tool according to this invention is shown on FIG. 2. On this figure, there are shown two dies 122, 132, positioned one on top of the other: the upper die 132 on top of the lower die 122. Both dies are disc-shaped and are engraved on their surface with an annular recess 122*a* and 132*a* respectively. Both recesses 122*a* and 132*a* are coaxial and define therebetween an annular recess with a XX axis perpendicular to the plane of the die discs. The recess 122*a*-132*a* matches the shape of the part after the latter has been hit between both dies.

Both dies are bored in their centre. The bore 122*b* crossing the lower die 122 is cylindrical with a XX axis having a radius R1 with its radius being broadened R2>R1 in its lower part.

The bore 132*b* crossing the upper die is cylindrical, with an axis XX having a radius R' slightly higher than R. On the lower part of the die, the bore comprises a tapered portion 132*c* forming a centering cone.

On the figure, a column 140 is engaged in the bore 122*b*. The column comprises a collar 140*a* on its lower part, the shape of which matches the tapered portion 122*c* of the lower die. The column has a diameter R and its height H is determined by the rebound expected from the hit part.

The operation of the rammer is as follows. There is shown, on FIG. 3, the lower die 122 provided with the column 140 and housed in its insert holder. The column 140 is positioned by the collar being immobilized between the insert and the bottom of the insert holder.

The upper die 132 is mounted on the upper insert holder opposite the lower die. In such a position, the bore 132*b* is located in the continuation of the column 140. The upper insert holder is provided with guiding and centering columns 134 cooperating with bores arranged in the upper insert holder. The function of such columns is to provide for an adequate positioning of both dies one relative to the other when the part is being hit.

The blank part E is positioned on the lower die in the recess 122*a* and the hitting mechanism is activated. The upper die is driven against the lower die. While the upper die moves, the projecting portion of the column is engaged in the bore 132*b*. The introduction of the column 140 into the bore is made easier by the centering cone. In addition, the bore radius of the upper die is sufficient compared to that of the column so as to avoid excessive frictions.

The shift velocity of the upper die is in the range from 1 to 2 m/s.

By means of the energy being applied, the part is shaped for matching the recesses 122*a*-132*a*. In the same motion, the die is lifted and the part rebounds on some height being a function of the mechanical energy being transferred to it. The annular part shifts upwards and topples on one side. Such a toppling movement is stopped by the projecting portion of the column. The part falls back in the central part of the lower die. If the part does not fall again in the annular recess 122*a*, the operator could easily handle it so as to position it properly without any risk. The height of the column is sufficient so as to prevent the part from being ejected beyond the latter.

The invention claimed is:

1. A tool for rammer die-cutting an annular part comprising:

a lower insert holder with a disc-shaped lower die, the lower die including a first die-cutting annular recess and a first bore provided at a center of the lower die;

an upper insert holder with a disc-shaped upper die, the upper die including a planar interior face, a second die-cutting annular recess, coaxial with the first die-cutting annular recess, provided in the interior face, the second die-cutting annular recess including first and second side surfaces extending towards the upper insert holder and a connecting surface that connects the first and second side surfaces, and a second bore provided at a center of the upper die, the lower insert holder cooperating with the upper insert holder such that the first and second die-cutting annular recesses define an annular recess therebetween with an axis perpendicular to a plane of the lower and upper dies; and a column arranged between the lower die and the upper die and guiding the part and restricting side motions of the part while the part is lifted from the lower die, wherein a lower part of the column is engaged in the first bore in the lower die, and wherein the column directly faces the annular recess defined by the first and second die-cutting recesses when the lower insert holder cooperates with the upper insert holder.

2. A tool according claim 1, wherein the column comprises an axial wedging collar cooperating with a housing provided in the lower die.

3. A tool according to claim 1, wherein a height of the column is at least equal to a rebounding height of the part.

4. A tool according to claim 1, wherein the second bore provided in the upper die comprises a centring cone.

5. A tool according to claim 1, further comprising guiding columns between the lower insert holder and the upper insert holder.

6. A tool according to claim 1, wherein the second bore includes a tapered portion on a lower part of the upper die.

7. A method for rammer die-cutting an annular part comprising:

positioning a tool in the rammer according to claim 1; and hitting the part using the tool.

* * * * *